US007977931B2

(12) United States Patent
Wadhwa

(10) Patent No.: US 7,977,931 B2
(45) Date of Patent: Jul. 12, 2011

(54) FAMILY OF CURRENT/POWER-EFFICIENT HIGH VOLTAGE LINEAR REGULATOR CIRCUIT ARCHITECTURES

(75) Inventor: Sameer Wadhwa, San Diego, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 574 days.

(21) Appl. No.: 12/050,874

(22) Filed: Mar. 18, 2008

(65) Prior Publication Data

US 2009/0237040 A1 Sep. 24, 2009

(51) Int. Cl.
*G05F 3/16* (2006.01)

(52) U.S. Cl. ..... 323/314; 323/316

(58) Field of Classification Search ..... 323/304, 323/311, 312, 313, 314, 315, 316
See application file for complete search history.

(56) References Cited

U.S. PATENT DOCUMENTS

| | | | | |
|---|---|---|---|---|
| 3,921,091 | A * | 11/1975 | Van Kessel et al. | 330/254 |
| 4,004,293 | A | 1/1977 | Osburn | |
| 4,954,789 | A | 9/1990 | Sampsell | |
| 5,018,256 | A | 5/1991 | Hornbeck | |
| 5,099,353 | A | 3/1992 | Hornbeck | |
| 5,125,112 | A | 6/1992 | Pace et al. | |
| 5,130,635 | A | 7/1992 | Kase | |
| 5,481,274 | A | 1/1996 | Aratani et al. | |
| 5,483,260 | A | 1/1996 | Parks et al. | |
| 5,576,656 | A | 11/1996 | McClure | |
| 5,613,103 | A | 3/1997 | Nobutani et al. | |
| 5,650,834 | A | 7/1997 | Nakagawa et al. | |
| 5,784,189 | A | 7/1998 | Bozler et al. | |
| 5,939,867 | A | 8/1999 | Capici et al. | |
| 6,040,937 | A | 3/2000 | Miles | |
| 6,246,398 | B1 | 6/2001 | Koo | |
| 6,323,982 | B1 | 11/2001 | Hornbeck | |
| 6,433,917 | B1 | 8/2002 | Mei et al. | |
| 6,466,486 | B2 | 10/2002 | Kawasumi | |
| 6,552,840 | B2 | 4/2003 | Knipe | |
| 6,574,033 | B1 | 6/2003 | Chui et al. | |
| 6,614,300 | B2 * | 9/2003 | Mages | 330/133 |
| 6,650,455 | B2 | 11/2003 | Miles | |
| 6,674,562 | B1 | 1/2004 | Miles et al. | |
| 6,680,792 | B2 | 1/2004 | Miles | |
| 6,710,908 | B2 | 3/2004 | Miles et al. | |
| 6,750,876 | B1 | 6/2004 | Atsatt et al. | |

(Continued)

FOREIGN PATENT DOCUMENTS

JP 2002 175053 6/2002

(Continued)

OTHER PUBLICATIONS

Lee et al., 2001, A supply-noise-insensitive CMOS PLL with a voltage regulator using DC-DC capacitive converter, IEEE Journal of Solid-State Circuits, 36(10):1453-1463.

(Continued)

*Primary Examiner* — Gary L Laxton
(74) *Attorney, Agent, or Firm* — Knobbe Martens Olson & Bear, LLP

(57) ABSTRACT

Power efficient power supply regulator circuits are disclosed. The circuits are configured to modify their overhead current according to current load. This is particularly advantageous for use in display devices with widely varying current loads. Such displays include bi-stable displays, such as interferometric modulation displays, LCD displays, and DMD displays.

25 Claims, 8 Drawing Sheets

U.S. PATENT DOCUMENTS

| | | | | |
|---|---|---|---|---|
| 6,781,643 | B1 | 8/2004 | Watanabe et al. | |
| 6,813,060 | B1 | 11/2004 | Garcia et al. | |
| 6,825,835 | B2 | 11/2004 | Sano et al. | |
| 6,903,860 | B2 | 6/2005 | Ishii | |
| 7,123,216 | B1 | 10/2006 | Miles | |
| 7,126,316 | B1 | 10/2006 | Dow | |
| 7,161,728 | B2 | 1/2007 | Sampsell et al. | |
| 7,170,352 | B1 * | 1/2007 | Caldwell | 330/261 |
| 7,196,837 | B2 | 3/2007 | Sampsell et al. | |
| 7,327,510 | B2 | 2/2008 | Cummings et al. | |
| 7,345,805 | B2 | 3/2008 | Chui | |
| 7,544,921 | B2 * | 6/2009 | Boemler | 250/214 A |
| 2002/0000959 | A1 | 1/2002 | Colgan et al. | |
| 2002/0171403 | A1 | 11/2002 | Lopata | |
| 2005/0168431 | A1 | 8/2005 | Chui | |
| 2005/0218509 | A1 | 10/2005 | Kipnis et al. | |
| 2005/0286114 | A1 | 12/2005 | Miles | |
| 2006/0044928 | A1 | 3/2006 | Chui et al. | |
| 2006/0066553 | A1 | 3/2006 | Deane | |
| 2006/0066598 | A1 | 3/2006 | Floyd | |
| 2006/0279495 | A1 | 12/2006 | Moe et al. | |
| 2007/0075942 | A1 | 4/2007 | Martin et al. | |
| 2008/0158647 | A1 | 7/2008 | Chui | |
| 2008/0158648 | A1 | 7/2008 | Cummings | |
| 2008/0160251 | A1 | 7/2008 | Cummings | |
| 2008/0192029 | A1 | 8/2008 | Anderson et al. | |
| 2009/0204349 | A1 | 8/2009 | Govil et al. | |

FOREIGN PATENT DOCUMENTS

| | | |
|---|---|---|
| JP | 2004 004553 | 8/2004 |

OTHER PUBLICATIONS

ISR and WO dated Dec. 18, 2009 in PCT/US09/037416.

Miles, MEMS-based interferometric modulator for display applications, Part of the SPIE Conference on Micromachined Devices and Components, vol. 3876, pp. 20-28 (1999).

Miles et al., 5.3: Digital Paper™: Reflective displays using interferometric modulation, SID Digest, vol. XXXI, 2000 pp. 32-35.

IPRP dated Jul. 9, 2010 in PCT/US09/037416.

* cited by examiner

FAMILY OF CURRENT/POWER-EFFICIENT HIGH VOLTAGE LINEAR REGULATOR CIRCUIT ARCHITECTURES

BACKGROUND

1. Field of the Invention

The field of the invention relates to microelectromechanical systems (MEMS). More specifically, the invention relates to voltage regulators for MEMS devices having a display with periods of low current consumption. One particular application can be found in MEMS display devices. The invention also relates to optical MEMS devices, in general, and bi-stable displays in particular.

2. Description of the Related Technology

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. MEMS technology is used, for example, in bi-stable display devices. One type of MEMS bi-stable display device is called an interferometric modulator. As used herein, the term interferometric modulator or interferometric light modulator refers to a device that selectively absorbs and/or reflects light using the principles of optical interference. In certain embodiments, an interferometric modulator may have a pair of conductive plates, one or both of which may be transparent and/or reflective in whole or part and capable of relative motion upon application of an appropriate electrical signal. In this type of device, one plate may be a stationary layer deposited on a substrate and the other plate may be a metallic membrane separated from the stationary layer by an air gap. The position of one plate in relation to another can change the optical interference of light incident on the interferometric modulator.

Because of the bi-stable characteristic of the display, the current load of the display varies greatly. The current load is largest while the display is being driven to change the image, when some or all of the bi-stable elements change states. Between the image update or refresh periods, the current load of the display is near zero. Under extremely low load conditions, the power consumption of conventional power supply regulator circuits dominates the total power consumption of the driver IC. A power supply configured to efficiently source current at a regulated voltage over widely varying current load is needed.

SUMMARY OF CERTAIN EMBODIMENTS

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

One aspect is a voltage regulator circuit, including an input stage having an input bias current, and an output stage having an output bias current, the output stage being configured to supply an output current at a regulated output voltage, where at least one of the input bias current and the output bias current is dependent at least in part on the output current.

Another aspect is a method of controlling a bias current in an output stage of voltage regulator circuit, the circuit configured to provide current substantially at a regulated output voltage. The method includes sensing a difference between a voltage based on the output voltage and a reference voltage, and generating a bias current based on the difference.

Another aspect is a voltage regulator circuit, including an input stage, and an output stage having an output bias current, the output stage being selectively connectable to a fixed current source and to a variable current source.

Another aspect is a voltage regulator circuit, including an input stage having an input bias current, and an output stage having an output bias current, the output stage being configured to supply an output current at a regulated output voltage, where at least one of the input bias current and the output bias current is based at least in part on the difference between a voltage based on the output voltage and a reference voltage.

Another aspect is a display including a plurality of bi-stable display elements, and a voltage regulator circuit, the voltage regulator circuit including an input stage having an input bias current, and an output stage having an output bias current, the output stage being configured to supply an output current at a regulated output voltage, where at least one of the input bias current and the output bias current is based at least in part on the output current.

DETAILED DESCRIPTION OF CERTAIN EMBODIMENTS

The following detailed description is directed to certain specific embodiments of the invention. However, the invention can be embodied in a multitude of different ways. In this description, reference is made to the drawings wherein like parts are designated with like numerals throughout. As will be apparent from the following description, the embodiments may be implemented in any device that is configured to display an image, whether in motion (e.g., video) or stationary (e.g., still image), and whether textual or pictorial. More particularly, it is contemplated that the embodiments may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Embodiments of the invention more particularly relate to displays which present widely varying current load to their voltage supplies. These embodiments for such displays are particularly power efficient because they are configured to modify their overhead current according to the current load. This is particularly advantageous for use in display devices which have periods of extremely low current load. Such displays include bi-stable displays, such as interferometric modulation displays, LCD displays, and DMD displays. Other displays, such as those with elements having three or more stable states can also benefit from increased power efficiency when using a power supply configured to modify its overhead current according to the current load.

Figure 1:
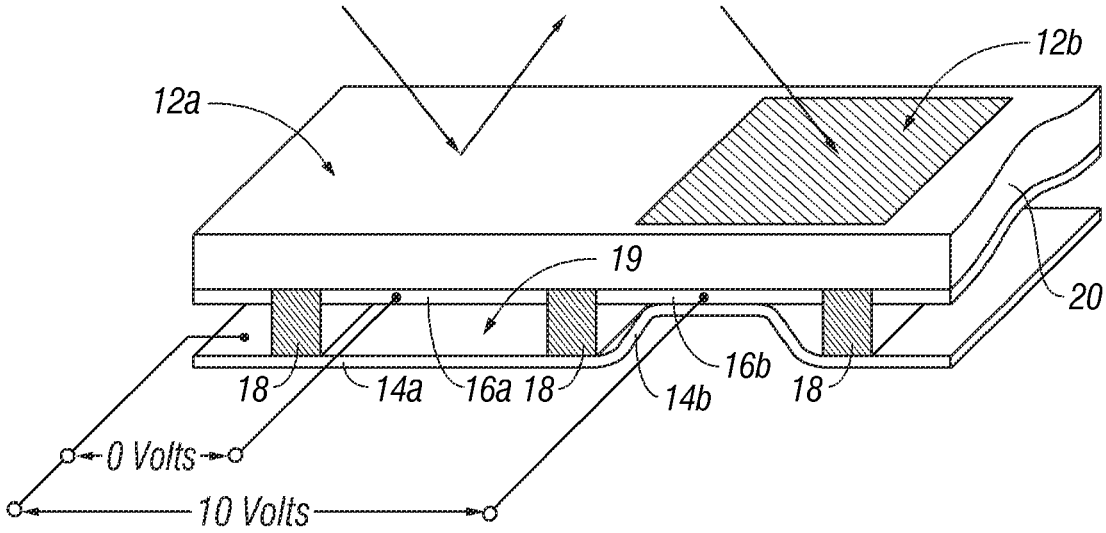
FIG. 1 is an isometric view depicting a portion of one embodiment of a bi-stable display, which is an interferometric modulator display in which a movable reflective layer of a first interferometric modulator is in a relaxed position and a movable reflective layer of a second interferometric modulator is in an actuated position.

An example of a display element which, when used in a display, results in widely varying current load on the voltage supplies is shown in FIG. 1, which illustrates a bi-stable display embodiment comprising an interferometric MEMS display element. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In one embodiment, one of the reflective layers may be moved between two positions. In the first position, referred to herein as the relaxed position, the movable reflective layer is positioned at a relatively large distance from a fixed partially reflective layer. In the second position, referred to herein as the actuated position, the movable reflective layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent pixels 12*a* and 12*b*. In the pixel 12*a* on the left, a movable reflective layer 14*a* is illustrated in a relaxed position at a predetermined distance from an optical stack 16*a*, which includes a partially reflective layer. In the pixel 12*b* on the right, the movable reflective layer 14*b* is illustrated in an actuated position adjacent to the optical stack 16*b*.

With no applied voltage, the cavity 19 remains between the movable reflective layer 14*a* and optical stack 16*a*, with the movable reflective layer 14*a* in a mechanically relaxed state, as illustrated by the pixel 12*a*. However, when a potential difference is applied to a selected row and column, the capacitor formed at the intersection of the row and column electrodes at the corresponding pixel becomes charged, and electrostatic forces pull the electrodes together. If the voltage is high enough, the movable reflective layer 14 is deformed and is forced against the optical stack 16. A dielectric layer (not illustrated in this Figure) within the optical stack 16 may prevent shorting and control the separation distance between layers 14 and 16, as illustrated by pixel 12*b* on the right in FIG. 1. The behavior is similar regardless of the polarity of the applied potential difference. Because the load presented to the power supply by the pixels 12*a* and 12*b* is capacitive, the current from the power supply is largest when the pixels 12*a* and 12*b* are being driven so as to charge and discharge, and is minimal when the pixels 12*a* and 12*b* are being held in either of the two stable states.

Figure 2:
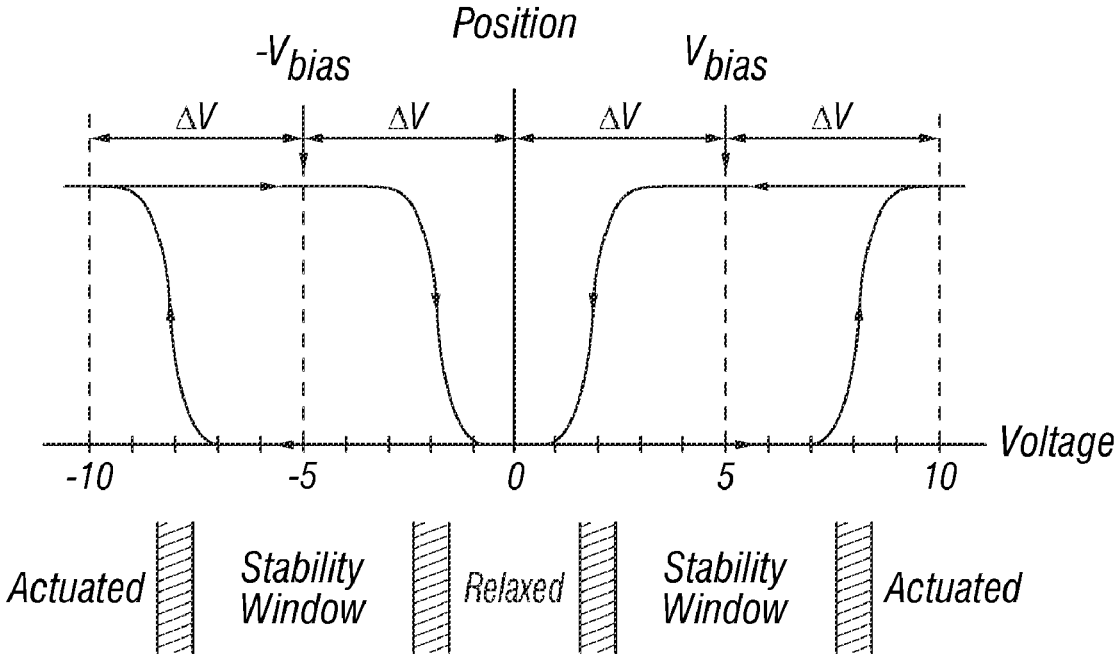
FIG. 2 is a diagram of movable mirror position versus applied voltage for one embodiment of the bi-stable display of FIG. 1.

FIG. 2 illustrates one process for using an array of interferometric modulators in a bi-stable display.

For MEMS interferometric modulators, the row/column actuation protocol may take advantage of a hysteresis property of these devices illustrated in FIG. 2. It may require, for example, a 10 volt potential difference to cause a movable layer to deform from the relaxed state to the actuated state. However, when the voltage is reduced from that value, the movable layer maintains its state as the voltage drops back below 10 volts. In the embodiment of FIG. 2, the movable layer does not relax completely until the voltage drops below 2 volts. There is thus a range of voltage, about 3 to 7 V in the example illustrated in FIG. 2, where there exists a window of applied voltage within which the device is stable in either the relaxed or actuated state. This is referred to herein as the "hysteresis window" or "stability window." For a display array having the hysteresis characteristics of FIG. 2, the row/column actuation protocol can be designed such that during row strobing, pixels in the strobed row that are to be actuated are exposed to a voltage difference of about 10 volts, and pixels that are to be relaxed are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or relaxed pre-existing state. Since each pixel of the interferometric modulator, whether in the actuated or relaxed state, is essentially a capacitor formed by the fixed and moving reflective layers, this stable state can be held at a voltage within the hysteresis window with almost no power dissipation. Essentially no current flows into the pixel if the applied potential is fixed. For this reason the display dissipates most of the power during data write and/or refresh periods.

Figure 3A:
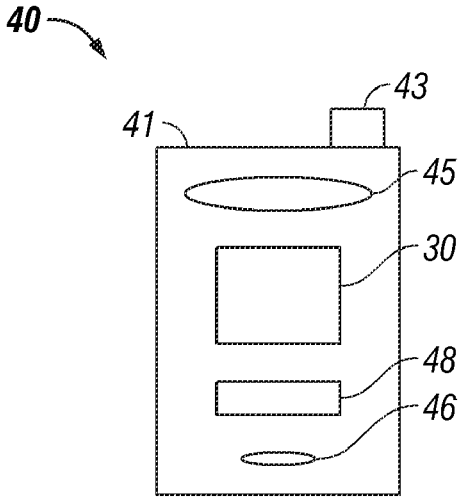
FIGS. 3A and 3B are system block diagrams illustrating an embodiment of a visual display device comprising a bi-stable display.
Figure 3B:
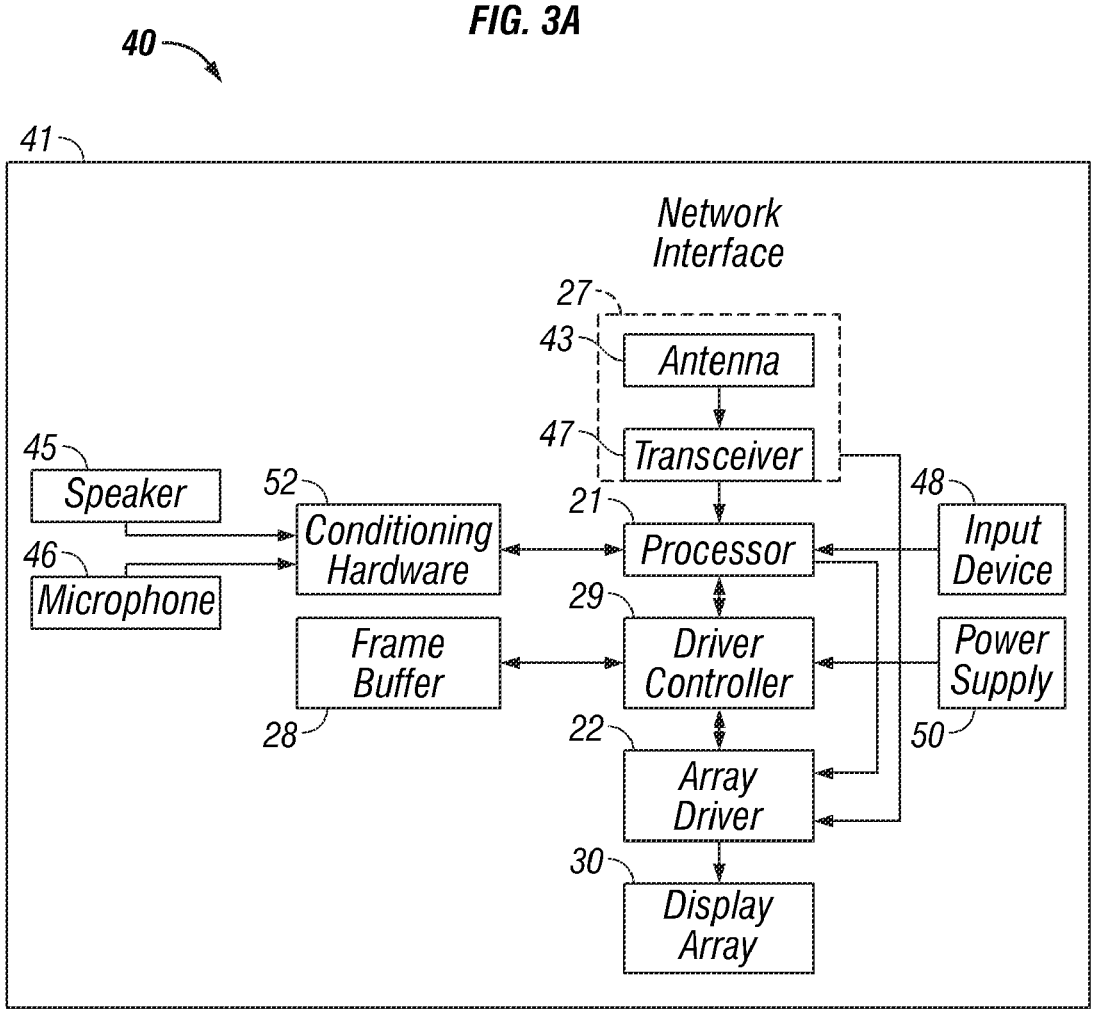

FIGS. 3A and 3B are system block diagrams illustrating an embodiment of a power efficient display device 40, in which bi-stable display elements, such as pixels 12*a* and 12*b* of FIG. 1 may be used with a power supply configured to modify its overhead current according to the current load. The display device 40 can be, for example, a cellular or mobile telephone. However, the same components of display device 40 or variations thereof are also illustrative of various types of display devices such as televisions and portable media players.

The display device 40 includes a housing 41, a display 30, an antenna 43, a speaker 44, an input device 48, and a microphone 46. The housing 41 is generally formed from any of a variety of manufacturing processes as are well known to those of skill in the art, including injection molding, and vacuum forming. In addition, the housing 41 may be made from any of a variety of materials, including but not limited to plastic, metal, glass, rubber, and ceramic, or a combination thereof. In one embodiment the housing 41 includes removable portions (not shown) that may be interchanged with other removable portions of different color, or containing different logos, pictures, or symbols.

The display 30 of exemplary display device 40 may be any of a variety of displays, including a bi-stable display, as described herein. In other embodiments, the display 30 includes a flat-panel display, such as plasma, EL, OLED, STN LCD, or TFT LCD as described above, or a non-flat-panel display, such as a CRT or other tube device, as is well known to those of skill in the art. However, for purposes of describing the present embodiment, the display 30 includes an interferometric modulator display, as described herein.

The components of one embodiment of exemplary display device 40 are schematically illustrated in FIG. 3B. The illustrated exemplary display device 40 includes a housing 41 and can include additional components at least partially enclosed therein. For example, in one embodiment, the exemplary display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g. filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. A power supply 50 provides power to all components as required by the particular exemplary display device 40 design.

The network interface 27 includes the antenna 43 and the transceiver 47 so that the exemplary display device 40 can communicate with one ore more devices over a network. In one embodiment the network interface 27 may also have some processing capabilities to relieve requirements of the processor 21. The antenna 43 is any antenna known to those of skill in the art for transmitting and receiving signals. In one embodiment, the antenna transmits and receives RF signals according to the IEEE 802.11 standard, including IEEE 802.11(a), (b), or (g). In another embodiment, the antenna transmits and receives RF signals according to the BLUETOOTH standard. In the case of a cellular telephone, the antenna is designed to receive CDMA, GSM, AMPS or other known signals that are used to communicate within a wireless cell phone network. The transceiver 47 pre-processes the signals received from the antenna 43 so that they may be received by and further manipulated by the processor 21. The transceiver 47 also processes signals received from the processor 21 so that they may be transmitted from the exemplary display device 40 via the antenna 43.

In an alternative embodiment, the transceiver 47 can be replaced by a receiver. In yet another alternative embodiment, network interface 27 can be replaced by an image source, which can store or generate image data to be sent to the processor 21. For example, the image source can be a digital video disc (DVD) or a hard-disc drive that contains image data, or a software module that generates image data.

Processor 21 generally controls the overall operation of the exemplary display device 40. The processor 21 receives data, such as compressed image data from the network interface 27 or an image source, and processes the data into raw image data or into a format that is readily processed into raw image data. The processor 21 then sends the processed data to the driver controller 29 or to frame buffer 28 for storage. Raw data typically refers to the information that identifies the image characteristics at each location within an image. For example, such image characteristics can include color, saturation, and gray-scale level.

In one embodiment, the processor 21 includes a microcontroller, CPU, or logic unit to control operation of the exemplary display device 40. Conditioning hardware 52 generally includes amplifiers and filters for transmitting signals to the speaker 45, and for receiving signals from the microphone 46. Conditioning hardware 52 may be discrete components within the exemplary display device 40, or may be incorporated within the processor 21 or other components.

The driver controller 29 takes the raw image data generated by the processor 21 either directly from the processor 21 or from the frame buffer 28 and reformats the raw image data appropriately for high speed transmission to the array driver 22. Specifically, the driver controller 29 reformats the raw image data into a data flow having a raster-like format, such that it has a time order suitable for scanning across the display array 30. Then the driver controller 29 sends the formatted information to the array driver 22. Although a driver controller 29, such as a LCD controller, is often associated with the system processor 21 as a stand-alone Integrated Circuit (IC), such controllers may be implemented in many ways. They may be embedded in the processor 21 as hardware, embedded in the processor 21 as software, or fully integrated in hardware with the array driver 22.

Typically, the array driver 22 receives the formatted information from the driver controller 29 and reformats the video data into a parallel set of waveforms that are applied many times per second to the hundreds and sometimes thousands of leads coming from the display's x-y matrix of pixels.

In one embodiment, the driver controller 29, array driver 22, and display array 30 are appropriate for any of the types of displays described herein. For example, in one embodiment, driver controller 29 is a conventional display controller or a bi-stable display controller (e.g., an interferometric modulator controller). In another embodiment, array driver 22 is a conventional driver or a bi-stable display driver (e.g., an interferometric modulator display). In one embodiment, a driver controller 29 is integrated with the array driver 22. Such an embodiment is common in highly integrated systems such as cellular phones, watches, and other small area displays. In yet another embodiment, display array 30 is a typical display array or a bi-stable display array (e.g., a display including an array of interferometric modulators). In some embodiments, display array 30 is another display type.

The input device 48 allows a user to control the operation of the exemplary display device 40. In one embodiment, input device 48 includes a keypad, such as a QWERTY keyboard or a telephone keypad, a button, a switch, a touch-sensitive screen, a pressure- or heat-sensitive membrane. In one embodiment, the microphone 46 is an input device for the exemplary display device 40. When the microphone 46 is used to input data to the device, voice commands may be provided by a user for controlling operations of the exemplary display device 40.

In some implementations control programmability resides, as described above, in a driver controller which can be located in several places in the electronic display system. In some cases control programmability resides in the array driver 22.

Power supply 50 can include a variety of energy storage devices as are well known in the art. For example, in one embodiment, power supply 50 is a rechargeable battery, such as a nickel-cadmium battery or a lithium ion battery. In another embodiment, power supply 50 is a renewable energy source, a capacitor, or a solar cell, including a plastic solar cell, and solar-cell paint. In another embodiment, power supply 50 is configured to receive power from a wall outlet. The power supply 50 may also have a power supply regulator configured to supply current for driving the display at a substantially constant voltage. In some embodiments, the constant voltage is based at least in part on a reference voltage, where the constant voltage may be fixed at a voltage greater than or less than the reference voltage. For a passive matrix bi-stable display, two or more power supply regulators outputting different voltage levels are usually present. For example, the display may require a common node, a +5V supply relative to common, and a −5V supply relative to common. Each regulator will be connected to the battery or other energy source and be configured to output a desired regulated voltage relative to the common node. The array driver 22 receives the different voltage levels and switches them to the rows and columns with the appropriate timing according to the display write process being used. When a given row or column of the array is switched from one voltage level to another during a data write operation, capacitances are charged and discharged and the power regulators deliver current to the display array 30. In between data write operations, no switching is being performed, and the capacitors maintain their existing charge levels. The only current being supplied at these times is due to leakage through dielectric layers, which is very low.

Those of skill in the art will recognize that the above-described architecture may be implemented in any number of hardware and/or software components and in various configurations. For example, in some embodiments, the power supply regulator is external to power supply 50.

Figure 4:
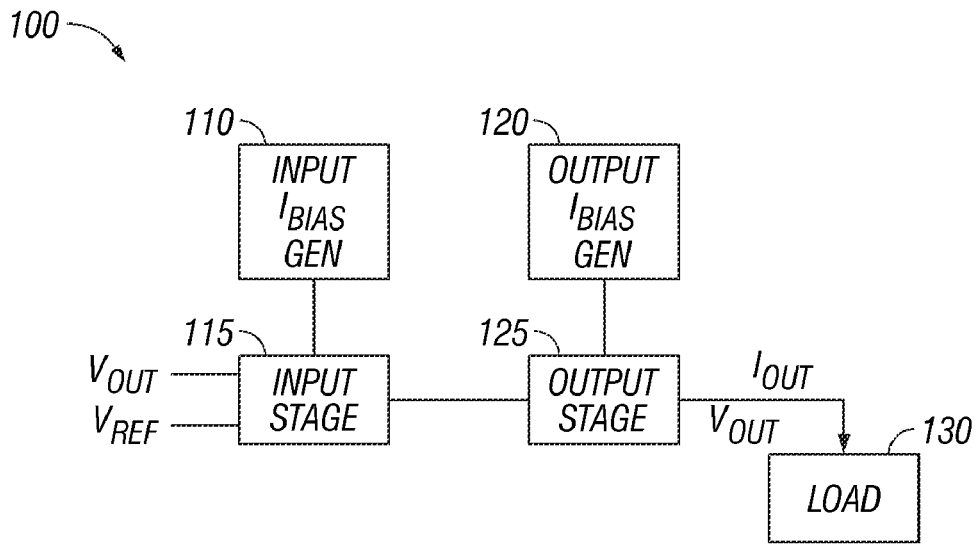
FIG. 4 is a block diagram of a particularly efficient power supply regulator.

FIG. 4 is a block diagram of a particularly efficient power supply regulator 100 configured to supply current for driving the display. The overhead current of power supply regulator 100 is dependent on its current output. The power supply regulator 100 has an input stage 115 which receives an input bias current from input bias current generator 110, and an output stage 125 which receives an output bias current from output bias current generator 120. The input stage 115 is configured to drive the output stage 125, and the output stage 125 is configured to provide the load 130 with a sufficient current Iout at voltage Vout based on a reference voltage Vref. In some embodiments, the output voltage Vout is substantially equal to the reference voltage Vref. In some embodiments, the output voltage Vout is less than or greater than Vref. In the embodiment shown in FIG. 4, power supply regulator 100 is configured to source current Iout to load 130 at voltage Vout, where Vout is substantially equal to Vref. One advantageous aspect of this architecture is that it allows for the input and output stages to be powered from different power supplies. This allows for separate optimization of power for each stage.

The input stage 115 is configured to provide a signal to the output stage 125 based on the difference of the voltage Vout and the reference voltage Vref. The output stage 125 is configured to provide a current Iout to load 130 based on the signal received from the input stage 115.

In the embodiment shown in FIG. 4, at least one of the input bias current generator 110 and the output bias current generator 120 is configured to generate a bias current based at least in part on the output current Iout. This feature is particularly advantageous because the power supply regulator 100 is configured to dynamically determine the bias current for either or both of the input stage and the output stage. One or more of the bias currents may be determined based at least in part on the current output Iout. At most, only a portion of the input and output bias current is provided to the load. Therefore, any bias current not provided to the load decreases efficiency. Dynamic determination of either or both of the bias currents based on the output current Iout provides for a particularly efficient voltage supply because large bias currents are generated only when large bias currents are needed. In some embodiments, the dynamic determination aspect may be selectably turned on or off. For example if the current load becomes less than a certain amount, the bias current can be supplied by a fixed source supplying small, but sufficient ibias.

In some embodiments, if insufficient current is available for the load, the voltage output Vout drops. In response, either or both of the input bias current generator 110 and the output bias current generator 120 modify the corresponding bias current based on difference between output voltage Vout and reference voltage Vref.

A relatively large difference between the output voltage Vout and the reference voltage Vref indicates that a larger bias current is necessary in at least one of the input stage 115 and the output stage 125. Accordingly, when a relatively large difference between the output voltage Vout and the reference voltage Vref exists, either or both of the input bias current generator 110 and the output bias current generator 120 is configured to increase the bias current provided. Once either or both of the input bias current generator 110 and the output bias current generator 120 receives the increased bias current, they cooperatively provide an increased output current Iout. In response, the difference between the output voltage Vout and the reference voltage Vref will decrease. Once the difference between the output voltage Vout and the reference voltage Vref is sufficiently small, the at least one of the input stage 115 and the output stage 125 stops increasing its bias current and maintains its bias current at only slightly more than is sufficient to supply the load 130 with current sufficient to generate the acceptable output voltage Vout.

Similarly, a relatively small difference between the output voltage Vout and the reference voltage Vref indicates that a smaller bias current is sufficient in at least one of the input stage 115 and the output stage 125. Accordingly, when a relatively small difference between the output voltage Vout and the reference voltage Vref exists, either or both of the input bias current generator 110 and the output bias current generator 120 is configured to decrease the bias current provided. Once either or both of the input bias current generator 110 and the output bias current generator 120 receives the decreased bias current, they cooperatively provide decreased output current Iout. In response, the difference between the output voltage Vout and the reference voltage Vref will increase. Once the difference between the output voltage Vout and the reference voltage Vref is sufficiently large, the at least one of the input stage 115 and the output stage 125 stops decreasing its bias current and maintains its bias current at only slightly more than is sufficient to supply the load 130 with current sufficient to generate the acceptable output voltage Vout.

Figure 5A:
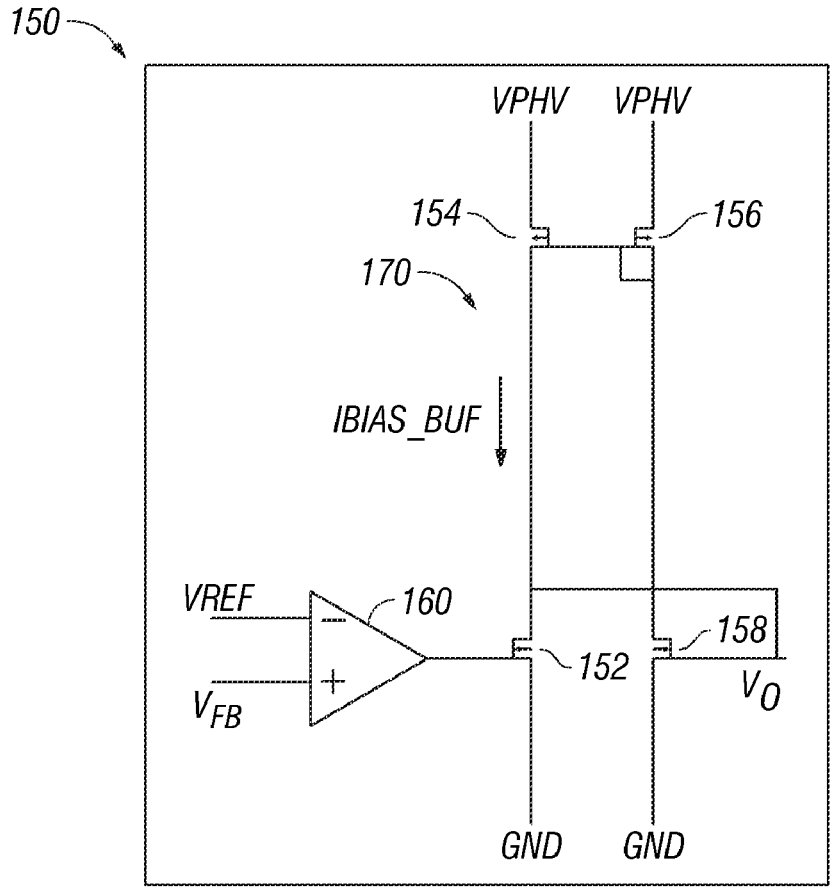
FIG. 5A is a schematic diagram of one embodiment of an input stage which can be used in a power supply regulator such as that shown in FIG. 4.

FIG. 5A shows one embodiment of input stage 150 which can be used in a power supply regulator such as that shown in FIG. 4. Input stage 150 has a differential amplifier 160 connected to buffer stage 170. The buffer stage 170 produces an output signal which can be used as an input for an output stage, such as output stage 125 of FIG. 4.

Differential amplifier 160 is configured to receive a reference voltage Vref and a feedback voltage Vfb. In some systems, the feedback voltage Vfb may be generated based on the output voltage of the voltage supply regulator. The difference between the reference voltage Vref and the feedback voltage Vfb is amplified by differential amplifier 160, which drives p-follower 152. The output of p-follower 152 is the input signal for the output stage, and is also used to generate bias current ibias_but, which is the bias current for the p-follower 152. Bias current ibias_buf is generated by mirror transistor 154, which mirrors the current in load transistor 156. Diode connected load transistor 156 acts as a load for active transistor 158. Accordingly, the differential amplifier 160 drives p-follower 152 with a voltage based on the difference between the voltage Vref and the feedback voltage Vfb. The p-follower 152 produces the input signal for the output stage, where the input signal also drives active transistor 158, inducing a current therein. The induced current is sourced by load device 156, and is mirrored by mirror transistor 154. The mirrored current is the bias current ibias_buf for the p-follower 152. Accordingly, when the input signal for the output stage is higher, the bias current for the p-follower 152 is higher. Similarly, when the input signal for the output stage is lower, the bias current for the p-follower 152 is lower.

In some embodiments, an additional current source (not shown) may also provide bias current for the p-follower 152. The additional current source may provide an amount of bias current which depends on the output current of the regulator in a different way than the current of mirror 154. In some embodiments, the additional current source provides current which is substantially independent of the output current of the regulator. For example, the additional current source may provide a substantially fixed current so that even if the current based on output current is very low, the bias current is at least equal to the current from the fixed additional current source.

Input stage 150 may be used to generate a signal Vo for an output stage, where the output stage is configured to generate an output voltage Vout based on the signal generated by the input stage 150. Because the bias current of the p-follower device 152 is generated based at least in part on the difference between the reference voltage Vref and the feedback voltage Vfb, and because the feedback voltage Vfb is generated based on the output voltage Vout (which is based on the current output), the bias current of the p-follower device 152 is dependent on the current output of the supply voltage regulator.

Figure 5B:
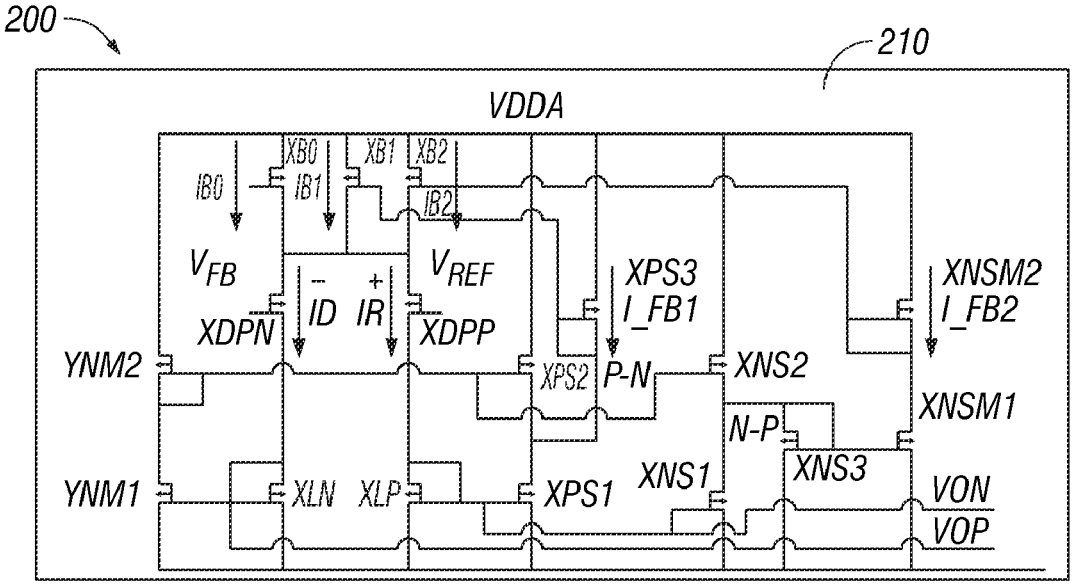
FIG. 5B is a schematic diagram of another embodiment of an input stage which can be used in a power supply regulator such as that shown in FIG. 4.

FIG. 5B shows another embodiment of an input stage 200 which can be used in a power supply regulator such as that shown in FIG. 4. Input stage 200 includes a differential pair formed by transistors XDPN and XDPP, a dynamic tail current generator formed by transistors XB1 and XB2, diode connected load transistors XLN and XLP, mirror transistors XNM1 and XNM2, positive current subtractor formed by transistors XPS1-XPS3, negative current subtractor formed by transistors XNS1-XNS3, and mirror transistors XNSM1 and XNSM2.

The bias tail current generator dynamically generates a current for the differential pair. The total current of the tail current generator is provided to the differential pair transistors XDPN and XDPP, and is conducted by the transistors XDPN and XDPP to the load transistors XLN and XLP. Because the transistors XDPN and XDPP are connected as a differential pair, the current in each of the transistors XDPN and XDPP depends on the difference in the gate voltages Vfb and Vref of the transistors XDPN and XDPP, respectively. For example, if Vfb is lower than Vref, more current will go through XDPN than goes through XDPP. As will be seen, the dynamic bias tail current generation is based on the difference in the differential pair currents. When the difference in the differential pair currents is small, a minimum bias tail current is provided, and when the difference is larger, a larger bias tail current is provided.

Input stage 200 has a positive current subtractor formed by transistors XPS1-XPS3, which provides a bias voltage for bias tail current transistor XB1. Transistor XB1 will provide a bias current to the differential pair which is mirrored from transistor XPS3 of the positive current subtractor. Transistor XPS3 sources an amount of current to transistor XPS1 which depends on the difference in currents of XPS1 and XPS2, according to the equation $I_{XPS3}=I_{XPS1}-I_{XPS2}$. The current in XPS1 is mirrored from load transistor XLP, and is, therefore, dependent on the current in transistor XDPP of the differential pair. The current in XPS2 is mirrored from load transistor XLN through mirror transistors XNM2 and XNM1, and is, therefore, dependent on the current in transistor XDPN of the differential pair. The current in XPS3 is, therefore, based on the difference between the currents in the differential pair, where if the current in XDPP is greater than the current in XDPN, the current in XPS3 is a positive amount based on the magnitude of the difference. Accordingly, bias tail current transistor XB1 provides a current to the differential pair based on the magnitude of the difference between the currents in the differential pair. Because XPS3 cannot source a negative current, if the current in XDPP is less than the current in XDPN, XPS3 sources zero current to transistor XPS1, and bias tail current transistor XB1, likewise sources zero current to the differential pair.

Input stage 200 has a negative current subtractor formed by transistors XNS1-XNS3, which provides a bias voltage for bias tail current transistor XB2. Transistor XB2 will provide a bias current to the differential pair which is mirrored from transistor XNS3 of the negative current subtractor through mirror transistors XNSM1 and XNSM2. Transistor XNS3 sinks an amount of current from transistor XNS2 which depends on the difference in currents of XNS2 and XNS1, according to the equation $I_{XNS3}=I_{XNS2}-I_{XNS1}$. The current in XNS1 is mirrored from load transistor XLP, and is, therefore, dependent on the current in transistor XDPP of the differential pair. The current in XNS2 is mirrored from load transistor XLN through mirror transistors XNM2 and XNM1, and is, therefore, dependent on the current in transistor XDPN of the differential pair. The current in XNS3 is, therefore, based on the difference between the currents in the differential pair, where if the current in XDPN is greater than the current in XDPP, the current in XNS3 is a positive amount based on the magnitude of the difference. Accordingly, bias tail current transistor XB3 provides a current to the differential pair based on the magnitude of the difference between the currents in the differential pair. Because XNS3 cannot sink a negative current, if the current in XDPN is less than the current in XDPP, XNS3 sinks zero current from transistor XNS2, and bias tail current transistor XB3, likewise sources zero current to the differential pair.

In some embodiments, an additional current source XB0 may also provide bias current for the differential pair. The additional current source XB0 may provide an amount of bias current which depends on the output current of the regulator in a different way than the current of bias tail current transistors XB1 and XB2. In some embodiments, the additional current source XB0 provides current which is substantially independent of the output current of the regulator. For example, the additional current source XB0 may provide a substantially fixed current so that even if the current based on output current is very low, the bias current is at least equal to the current from the additional current source XB0.

Input stage 200 may be used to generate a differential signal (Vop−Von) for an output stage, where the output stage is configured to generate an output voltage Vout based on the signal generated by the input stage 200. Because the bias tail current of the differential pair is generated based at least in part on the difference between the reference voltage Vref and the feedback voltage Vfb, and because the feedback voltage Vfb is generated based on the output voltage Vout (which is based on the current output), the bias tail current of the differential pair is dependent on the current output of the supply voltage regulator.

Figure 6A:
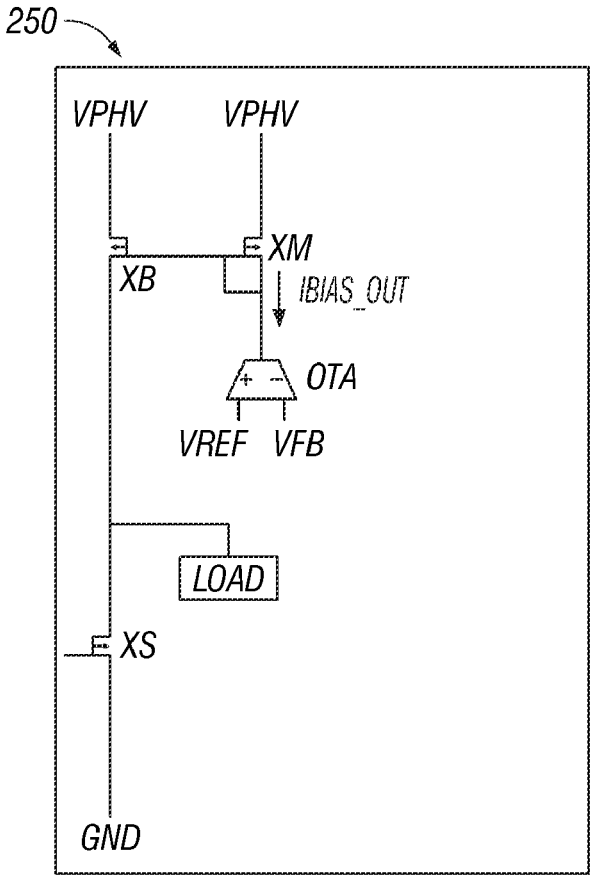
FIG. 6A is a schematic diagram of an embodiment of an output stage which can be used in a power supply regulator such as that shown in FIG. 4.

FIG. 6A shows an embodiment of an output stage 250 which can be used in a power supply regulator such as that shown in FIG. 4. Output stage 250 includes signal transistor XS, bias transistor XB, mirror transistor XM, and an operational transconductance amplifier OTA.

The signal transistor XS receives an input signal (from, for example, the input stage of FIG. 4) and sinks a current according to the received signal. When the output stage 250 is used in a power supply regulator such as that shown in FIG. 4, the bias transistor XB sources a bias current for the signal transistor XS and for an output current for the load, where the output current is the current sourced by the bias transistor XB minus the current sunk by the signal transistor XS. The power supply regulator operates by modifying the input signal such that if more current is needed for the load, the signal transistor sinks less current, leaving more for the load. Similarly, if less current is needed for the load, the input signal is modified such that the signal transistor sinks more current, leaving less for the load.

The bias transistor XB sources the bias current based on a reference current mirrored from the OTA through mirror transistor XM. In this embodiment, the OTA generates a current based on the difference between a reference voltage Vref and a feedback voltage Vfb. Because Vfb is generated based on the voltage output of the power supply regulator, the difference between the reference voltage Vref and the feedback voltage is related to the current output of the power supply regulator. Accordingly, the bias current of the output stage 250 is based at least in part on the current output of the power supply regulator. The adjustment of the current allows for the bias transistor XB to provide large amounts of current when needed, and to provide less current when less is sufficient. In addition, because of the dynamic control of the bias current, the transistor XB can be smaller than what would otherwise be required to provide the large currents. The smaller size results in better power and area efficiency of the circuit.

In some embodiments, the output of the regulator is targeted to be the dominant pole. Accordingly, the poles associated with the bias current control must lie at relatively high frequencies to achieve good phase margin. This may be achieved, for example, by using current mode control so that all nodes associated with the bias control have relatively low impedance. Following this principle, the OTA of FIG. 6A produces an output current which is proportional to the difference between the regulator output and the target regulation level. In some embodiments, the OTA operates at a low voltage supply to reduce power consumption.

In some embodiments, an additional current source (not shown) may also provide bias current for the signal transistor XS and for the output current for the load. The additional current source may provide an amount of bias current which depends on the output current of the regulator in a different way than the current of bias transistor XB. In some embodiments, the additional current source provides current which is substantially independent of the output current of the regulator. For example, the additional current source may provide a substantially fixed current so that even if the current based on output current is very low, the bias current is at least equal to the current from the fixed additional current source.

Figure 6B:
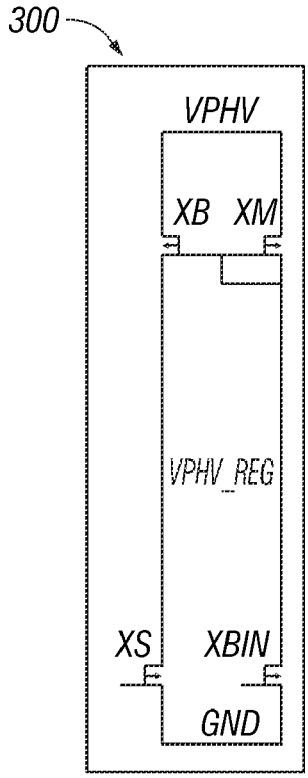
FIG. 6B is a schematic diagram of another embodiment of an output stage which can be used in a power supply regulator such as that shown in FIG. 4.

FIG. 6B shows another embodiment of an output stage 300 which can be used in a power supply regulator such as that shown in FIG. 4. Output stage 300 includes signal transistor XS, bias input transistor XBIN, mirror transistor XM, and bias transistor XB.

The signal transistor XS receives an input signal (from, for example, the input stage of FIG. 4) and sinks a current according to the received signal. When the output stage 300 is used in a power supply regulator such as that shown in FIG. 4, the bias transistor XB sources a bias current for the signal transistor XS and for an output current for the load, where the output current is the current sourced by the bias transistor XB minus the current sunk by the signal transistor XS. The power supply regulator operates by modifying the input signal such that if more current is needed for the load, the signal transistor XS sinks less current, leaving more for the load. Similarly, if less current is needed for the load, the input signal is modified such that the signal transistor XS sinks more current, leaving less for the load.

The bias transistor XB sources the bias current based on a reference current mirrored from the bias input transistor XBIN through mirror transistor XM. In some embodiments, the input for the bias input transistor XBIN is generated by the power source regulator based on the current sourced to the load. For example, in some embodiments, the input for the bias input transistor XBIN is based on the difference between a voltage based on an output voltage of the regulator and a reference voltage. Because the input for the bias input transistor XBIN is generated based on the current output of the power supply regulator, the bias current of the output stage 300 is based at least in part on the current output of the power supply regulator.

In some embodiments, an additional current source (not shown) may also provide bias current for the signal transistor XS and for the output current for the load. The additional current source may provide an amount of bias current which depends on the output current of the regulator in a different way than the current of bias transistor XB. In some embodiments, the additional current source provides current which is substantially independent of the output current of the regulator. For example, the additional current source may provide a substantially fixed current so that even if the current based on output current is very low, the bias current is at least equal to the current from the fixed additional current source.

Figure 6C:
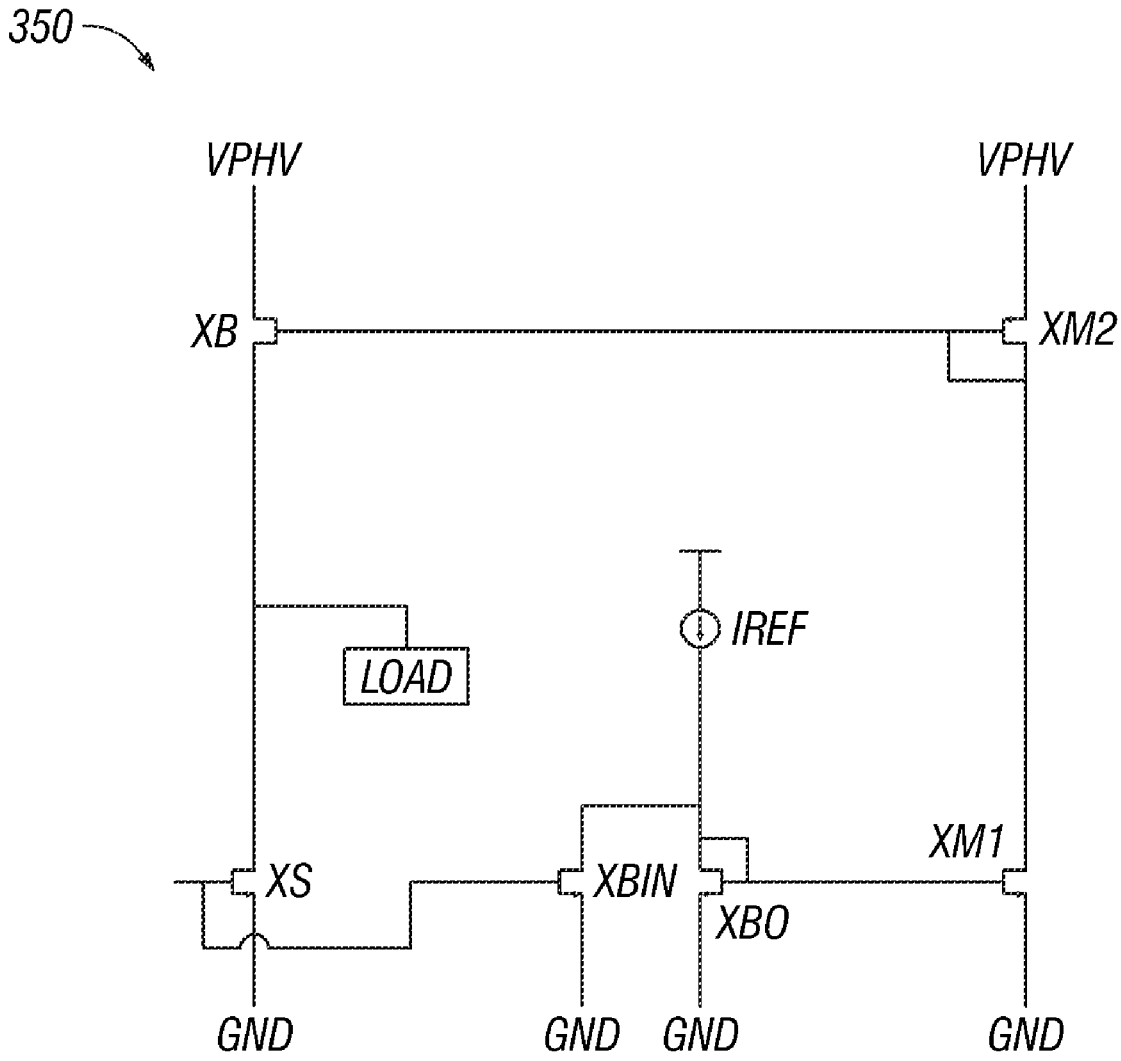
FIG. 6C is a schematic diagram of yet another embodiment of an output stage which can be used in a power supply regulator such as that shown in FIG. 4.

FIG. 6C shows yet another embodiment of an output stage 350 which can be used in a power supply regulator such as that shown in FIG. 4. Output stage 350 includes signal transistor XS, bias input transistor XBIN, bias reference transistor XB0, mirror transistors XM1 and XM2, and bias transistor XB.

The signal transistor XS receives an input signal and sinks a current according to the received signal. When the output stage 350 is used in a power supply regulator such as that shown in FIG. 4, the bias transistor XB sources a bias current for the signal transistor XS and for an output current for the load, where the output current is the current sourced by the bias transistor XB minus the current sunk by the signal transistor XS. The power supply regulator operates by modifying the input signal such that if more current is needed for the load, the signal transistor XS sinks less current, leaving more for the load. Similarly, if less current is needed for the load, the input signal is modified such that the signal transistor XS sinks more current, leaving less for the load.

The bias transistor XB sources the bias current based on a reference current mirrored from the bias reference transistor XB0 through mirror transistors XM1 and XM2. The current in the bias reference transistor XB0 is equal to the current sourced by current reference IREF which is not sunk by the bias input transistor XBIN. In this embodiment, the input for the bias input transistor XBIN is the same as the input for the signal transistor XS, and is generated by the power source regulator based on the current sourced to the load. For example, in some embodiments, the input for the bias input transistor XBIN and for the signal transistor XS is based on the difference between a voltage based on an output voltage of the regulator and a reference voltage. Because the input for the bias input transistor XBIN is generated based on the current output of the power supply regulator, the bias current of the output stage 350 is based at least in part on the current output of the power supply regulator.

In some embodiments, an additional current source (not shown) may also provide bias current for the signal transistor XS and for the output current for the load. The additional current source may provide an amount of bias current which depends on the output current of the regulator in a different way than the current of bias transistor XB. In some embodiments, the additional current source provides current which is substantially independent of the output current of the regulator. For example, the additional current source may provide a substantially fixed current so that even if the current based on output current is very low, the bias current is at least equal to the current from the fixed additional current source.

Figure 7:
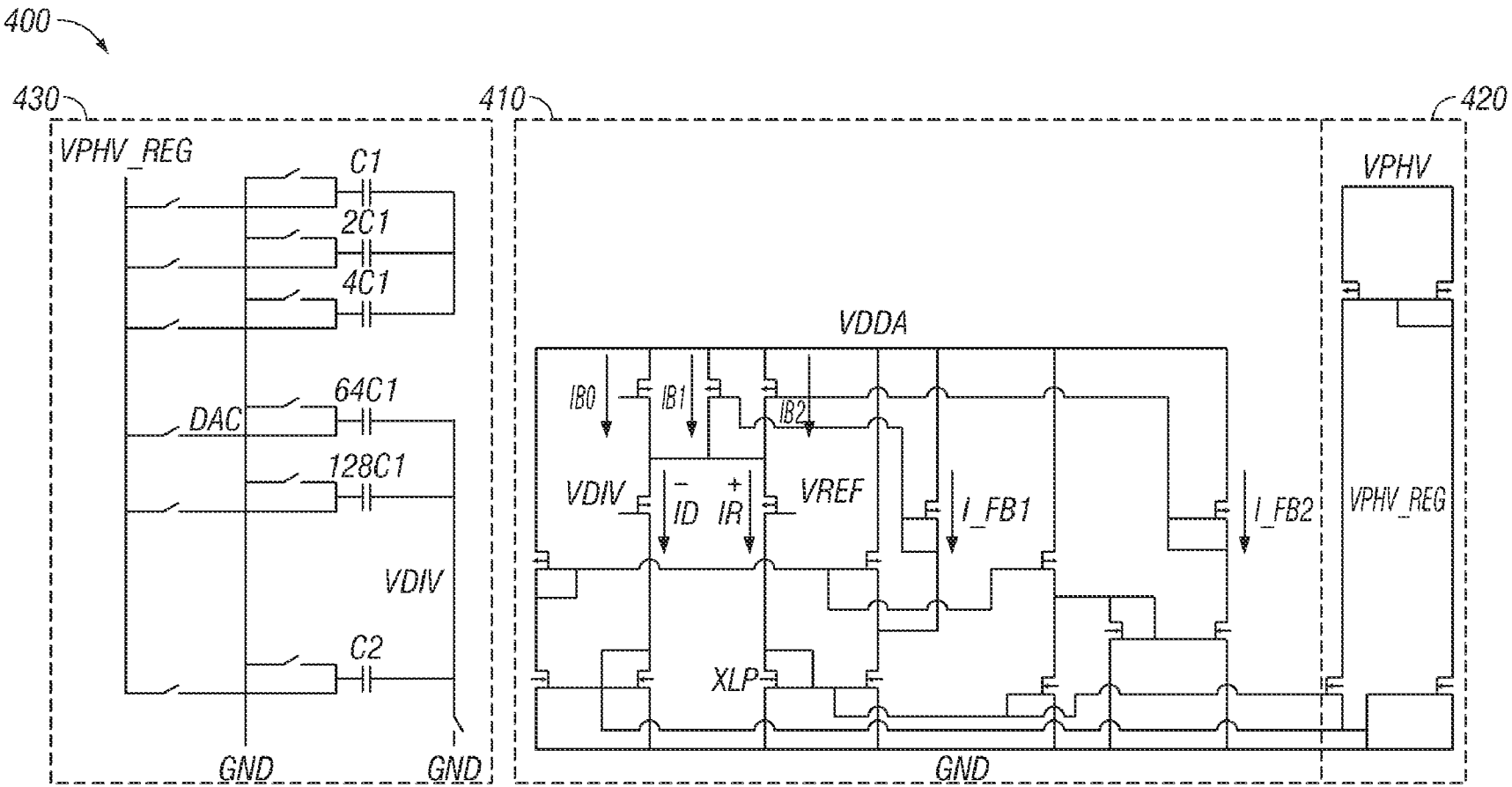
FIG. 7 is a schematic diagram of an embodiment of a power supply regulator configured to generate both an input bias current and an output bias current based at least in part on the current output of the regulator.

FIG. 7 shows an embodiment of a power supply regulator 400 configured to source a supply current for the load, and to generate both an input bias current and an output bias current based at least in part on the current output of the regulator. Power supply regulator 400 has an input stage 410, an output stage 420 and a feedback stage 430. Input stage 410 is similar to input stage 200 of FIG. 5B, output stage 420 is similar to output stage 300 of FIG. 6B.

In this embodiment, the output stage 420 is supplied by power supply voltage VPHV and the input stage 410 is supplied by power supply voltage VDDA. Because in some embodiments the input stage 410 can operate at a lower supply voltage, VDDA may be less than VPHV. This allows the input stage 410 to operate with lower power consumption. In some embodiments, the output stage also operates at a lower supply voltage. In some embodiments, the output stage can be configured to selectably operate with VPHV when the current output of the regulator is high and to operate with VDDA when the current output of the regulator is below a threshold.

Feedback stage 430 is a switched capacitor divider circuit which is configured to be programmed with a division factor. In this embodiment, feedback stage 430 takes the voltage output of the power supply regulator 420 and divides it according to its programming. With this configuration, the output voltage will be substantially equal to the division factor times the reference voltage Vref.

Figure 8:
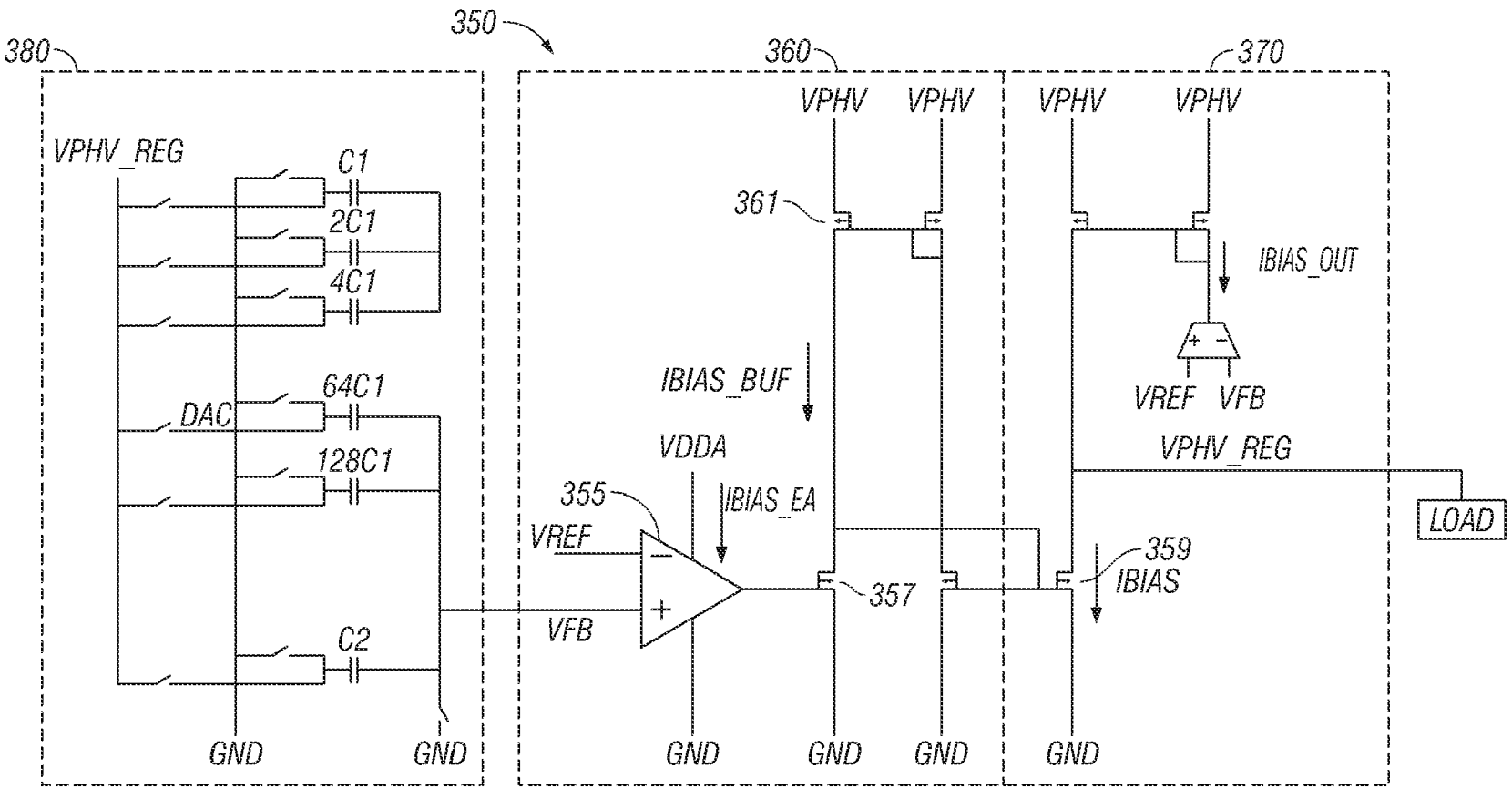
FIG. 8 is a schematic diagram of an embodiment of a power supply regulator configured to generate both an input bias current and an output bias current based at least in part on the current output of the regulator.

FIG. 8 shows an embodiment of a power supply regulator 350 configured to source a supply current for the load, and to generate both an input bias current and an output bias current based at least in part on the current output of the regulator. Power supply regulator 350 has an input stage 360, an output stage 370 and a feedback stage 380. Input stage 360 is similar to input stage 150 of FIG. 5A, and output stage 370 is similar to output stage 250 of FIG. 6A, and feedback stage 380 is similar to feedback stage 430 of FIG. 7.

Although shown as separate devices in this schematic, some embodiments integrate one or more portions of power supply regulator 350 with different architectures. For example, the OTA of the output stage 370 may be integrated with the amplifier of the input stage 360 to achieve better performance matching between the two amplifiers.

As shown, the amplifier 355 drives an N-type pull-down device 359 of the output stage 370 through a P source follower 357. Since the amplifier is driving an N pull-down device 359, its output can swing over a limited range. This allows for a lower supply voltage for the amplifier, resulting in lower power consumption.

The P-type source follower 357 serves at least two purposes. First, it provides a buffer to the output of the amplifier and thus enables the use of a high gain amplifier without introducing a low frequency pole. Second, it level-shifts up the output of the error amplifier, thus providing additional overdrive to the N pull-down device 359. In the embodiment shown in FIG. 8, the amount of the level-shift is a function of the pull-down current by feeding back current into the source follower through P device 361. Thus, the level-shift is larger when the regulator sinking current is larger. This helps reduce the required size of the N pull-down device.

While the above detailed description has shown, described, and pointed out novel features as applied to various embodiments, it will be understood that various omissions, substitutions, and changes in the form and details of the device or process illustrated may be made by those skilled in the art without departing from the spirit of the invention. As will be recognized, the present invention may be embodied within a form that does not provide all of the features and benefits set forth herein, as some features may be used or practiced separately from others.

What is claimed is:

1. A voltage regulator circuit, comprising:

an input stage configured to receive an input bias current and generate a first output voltage;

an output stage configured to receive the first output voltage and an output bias current, and to supply an output current at a regulated output voltage based on the first output voltage and the output bias current; and a generator configured to generate at least one of the input bias current and the output bias current, wherein the generator is configured to at least one of:

receive the first output voltage to generate the input bias current, and independent of the input stage, generate the output bias current based on the regulated output voltage.

2. The circuit of claim 1, wherein at least one of the input bias current and the output bias current is dependent at least in part on the output current.

3. The circuit of claim 1, further comprising a substantially fixed current source and a variable current source, wherein the circuit is configured to connect at least one of the fixed current source and the variable current source to a node based at least in part on the output current.

4. The circuit of claim 3, wherein the variable current source varies dependent at least in part on the difference between a voltage based on the regulated output voltage and a reference voltage.

5. The circuit of claim 1, further comprising a differential pair circuit configured to receive a tail current and a differential input voltage, wherein the tail current is dependent at least in part on the differential input voltage.

6. The circuit of claim 5, wherein the differential pair circuit produces a differential output current, and comprises first and second variable tail current generators, wherein the first and second tail current generators are configured to generate tail current based on opposite polarities of the differential output current.

7. The circuit of claim 1, wherein the input stage is configured to receive an input supply voltage and the output stage circuit is configured to receive an output supply voltage and the input supply voltage is different from the output supply voltage.

8. A method of controlling an output bias current in an output stage circuit of a voltage regulator circuit, the voltage regulator circuit configured to provide current substantially at a regulated output voltage, wherein the voltage regulator circuit comprises an input stage receiving an input bias current and generating a first output voltage, and an output stage receiving the first output voltage and the output bias current and generating the regulated output voltage based on the first output voltage, the method comprising:

sensing a difference between a voltage based on the output voltage and a reference voltage; and independent of the first stage, generating the output bias current based on the difference.

9. The method of claim 8, further comprising increasing the bias current if the difference increases.

10. The method of claim 8, further comprising maintaining a fixed bias current if the difference decreases below a threshold.

11. The method of claim 8, further comprising producing a tail current amount for a differential pair of transistors in an amplifier circuit depending on the difference between the output voltage and the reference voltage.

12. A voltage regulator circuit, comprising:

an input stage circuit configured to receive an input bias current and to generate a first output voltage; and an output stage circuit configured to receive the first output voltage and an output bias current, and to supply an output current at a regulated output voltage based on the first output voltage and the output bias current; and a generator configured to generate at least one of the input bias current and the output bias current, wherein the generator is configured to at least one of:

receive the first voltage output to generate the input bias current, and independent of the input stage circuit, generate the output bias current based on a difference between a voltage based on the regulated output voltage and a reference voltage.

13. The circuit of claim 12, further comprising a differential pair circuit configured to receive a tail current and a differential input voltage, wherein the tail current is based at least in part on the difference.

14. The circuit of claim 13, wherein the differential pair circuit produces a differential output current, and comprises first and second variable tail current generators, wherein the first and second tail current generators are configured to generate tail current based on opposite polarities of the differential output current.

15. A display comprising:

a plurality of bi-stable display elements; and a voltage regulator circuit, the voltage regulator circuit comprising:

an input stage circuit configured to receive an input bias current and generate a first output voltage;

an output stage circuit configured to receive the first output voltage and an output bias current, and to supply an output current at a regulated output voltage based on the first output voltage and the output bias current; and a generator configured to generate at least one of the input bias current and the output bias current, wherein the generator is configured to at least one of:

receive the first output voltage to generate the input bias current, and independent of the input stage, generate the output bias current based on the regulated output voltage.

16. The display of claim 15, further comprising a substantially fixed current source and a variable current source, wherein the voltage regulator circuit is configured to connect at least one of the fixed current source and the variable current source to a node based at least in part on the output current.

17. The display of claim 16, wherein the variable current source varies based at least in part on the difference between a voltage based on the regulated output voltage and a reference voltage.

18. The display of claim 15, further comprising a differential pair circuit configured to receive a tail current and a differential input voltage, wherein the tail current is based at least in part on the differential input voltage.

19. The display of claim 15, wherein the input stage has an input supply voltage and the output stage has an output supply voltage and the input supply voltage is different from the output supply voltage.

20. A voltage regulator circuit, comprising:

first means for sensing a difference between a voltage based on the output voltage and a reference voltage;

means for generating an output current based on the difference sensed by the first sensing means; and means for generating a bias current, comprising second means for sensing the difference between the voltage based on the output voltage and the reference voltage, wherein the bias current is generated based on the difference sensed by the second sensing means and is generated independent of the difference sensed by the first sensing means.

21. The circuit of claim 20, wherein the second sensing means comprises a voltage comparator.

22. The circuit of claim 20, wherein the generating means forms in part, an output stage.

23. The circuit of claim 20, wherein the bias current generating means comprises a bias current generator.

24. The circuit of claim 23, wherein the bias current generator comprises a substantially fixed current source and a variable current source, wherein the circuit is configured to connect at least one of the fixed current source and the variable current source to a node based at least in part on the output current.

25. The circuit of claim 23, wherein the bias current generator comprises a differential pair having a tail current and a differential input voltage, wherein the tail current is dependent at least in part on the differential input voltage.

* * * * *